US005113205A

United States Patent [19]

Sato et al.

[11] Patent Number: 5,113,205

[45] Date of Patent: May 12, 1992

[54] INK JET HEAD

[75] Inventors: Hiroyuki Sato; Hitoshi Yauchi, both of Morioka, Japan

[73] Assignee: Alps Electric Co., Ltd., Tokyo, Japan

[21] Appl. No.: 692,426

[22] Filed: Apr. 29, 1991

[30] Foreign Application Priority Data

Jul. 2, 1990 [JP] Japan ..... 2-175107

[51] Int. Cl.[5] ..... B41J 2/19

[52] U.S. Cl. ..... 346/140 R

[58] Field of Search ..... 346/140 R, 75

[56] References Cited

U.S. PATENT DOCUMENTS 4,589,000 5/1986 Koto et al. ..... 346/140 R 4,590,494 5/1986 Ichihashi et al. ..... 346/140 R 4,609,925 9/1986 Nozu et al. ..... 346/1.1

FOREIGN PATENT DOCUMENTS 0188668 11/1983 Japan ..... 346/140 PD

*Primary Examiner*—Benjamin R. Fuller

*Assistant Examiner*—Alrick Bobb

*Attorney, Agent, or Firm*—Guy W. Shoup; B. Noël Kivlin

[57] ABSTRACT

An ink jet head used in an ink jet printer, having a flat nozzle block, and a main tank member which is connected to a base end of the nozzle block and in which is formed a main ink tank for storing ink supplied to ink flow passages formed in the nozzle block. An auxiliary tank member in which an auxiliary tank is formed is connected to the main tank member. A slant surface downwardly inclined from an upstream position to a downstream position with respect to the direction of ink supply is formed as a part of the upper internal wall of the ink tank. Supplied ink collides against this slant surface so that air in the ink separates from the ink.

2 Claims, 4 Drawing Sheets

INK JET HEAD

BACKGROUND OF THE INVENTION

This invention relates to an ink jet head for use in an ink jet printer and, more particularly, to an ink jet head designed to hinder formation of an air bubble or air cell in an ink tank of the ink jet head.

A conventional ink jet head of this kind will be described below with reference to FIGS. 5 to 8.

Referring to FIGS. 5 to 8, the ink jet head has a flat nozzle block 1 having a flat rectangular shape. The nozzle block 1 is formed by superposing a glass base plate 2A and a vibrating plate 2B on each other. A plurality of flow passages 3 each having an end formed into the shape of a nozzle 4 are formed in the inner surface of the base plate 2A having a substantially large thickness by etching the base plate 2A, as shown in FIGS. 6 and 8 in detail. On the upstream side of each ink flow passage 3, a constriction section 5 is formed which serves to check a back flow of ink when the ink is jetted through the nozzle 4.

A common electrode 6 is formed on a surface of the vibrating plate 2B at a position corresponding to the flow passages 3 between the nozzles 4 and the constriction sections 5. A plurality of piezoelectric elements 7 are formed on the surface of the common electrode 6 at positions corresponding to the flow passages 3, and selection electrodes are lead out from the surfaces of the piezoelectric elements 7. The piezoelectric elements 7 can be selectively energized in accordance with printing information to vibrate the corresponding portions of the vibrating plate 2B so that the ink in the corresponding ones of the flow passage 3 is jetted through the nozzles 4.

A tank member 8 is connected to a base end of the flat nozzle block 1. The tank member 8 has an overall rectangular parallelepiped shape, and a cylindrical projection 10 is integrally formed on an end surface 9A of the tank member 8 generally at the center thereof so as to project outward. An ink tank 11 is formed in the tank member 8. The ink tank 11 extends from the projection 10 on the end surface 9A to another end surface 9B opposite to the end surface 9A. The ink tank 11 has a small diameter at the end surface 9A and is extended in the longitudinal direction of the tank member 8 at an intermediate position between the two surfaces so that its longitudinal size at the end surface 9B corresponds to about $\frac{3}{4}$ of that of the end surface 9B. The base end of the nozzle block 1 is fitted into the tank member 8 at the end surface 9B so that the ink passages 3 communicate with the ink tank 11. An O ring 12 is fitted around an outer peripheral portion of the nozzle block 1 in the tank member 8 to prevent the ink from leaking along the outer peripheral surface of the nozzle block 1. The projection 10 of the ink tank 11 is connected to an ink supply source (not shown).

In this arrangement, ink is charged in the flow passages 3 of the nozzle block 1 by being supplied from the ink supply source through the ink tank 11 of the tank member 8, and the piezoelectric elements 7 are selectively energized in accordance with printing information to jet the ink through the nozzles 4 of the corresponding flow passages 3 so that color dots are formed on a printing sheet (not shown). It is possible to effect printing on the printing sheet by repeating such selective ink injection from the nozzles 4.

In the above-described conventional ink jet head, however, no air bleeder for discharging air from the ink tank 11 is formed and the ink is directly introduced into the ink tank 11 from the ink supply source. Air contained in the ink is separated from the ink and moves to an upper section of the ink tank 11 to form a bubble or air cell. The volume of the air cell in the upper section of the ink tank 11 is gradually increased as printing operation is continued. There is a possibility that the air cell finally reaches at least a part of the port of the uppermost flow passage 3 so that the amount of ink introduced into the uppermost flow passage 3 is reduced or, in the worst case, no ink is supplied to this flow passage 3. Thus, there is a risk of instability of ink jetting from the nozzle 4 of the uppermost flow passage 3 and, hence, a deterioration in printing quality.

A conventional means for avoiding such a problem is known which resides in previously filling the ink tank 11 of the tank member 8 with ink at the time of assembly of the nozzle block 1 and the tank member 8. If the nozzle block 1 and the tank member 8 are assembled in this condition, there is a risk of the ink in the ink tank 11 attaching to portions of the ink jet head, and the assembly is therefore difficult. On the other hand, since no special means for removing bubbles contained in the ink is provided, the possibility of a substantially large air cell being formed in the upper section of the ink tank 11 during continued printing is still high and, in some case, printing qualities are considerably influenced by such an air cell.

SUMMARY OF THE INVENTION

In view of the above-described problems of the conventional devices, an object of the present invention is to provide an ink jet head in which an air bubble or air cell formed in the ink tank is minimized to prevent a bad influence upon printing qualities.

Another object of the present invention is to provide an ink jet head having a flat nozzle block in which a plurality of flow passages each having one end formed as a nozzle are formed, and a main tank member which is connected to a base end of the nozzle block and in which a main ink tank for storing ink to be supplied to the flow passages is formed. In this ink jet head, an auxiliary tank member in which an auxiliary ink tank which communicates with the main ink tank is formed is connected to the main tank member. A discharge tube which communicates with an upper section of the auxiliary tank is provided on the auxiliary tank member. A slant surface downwardly inclined from an upstream position to a downstream position with respect to the direction of ink supply is formed as a part of the lower surface of an upper wall of the main ink tank.

Still another object of the present invention to provide an ink jet head of this construction wherein a communication passage for communication between upper portions of the main and auxiliary ink tanks is further formed.

In the ink jet head of the above construction, supplied ink collides against the slant surface so that air contained in the ink separates from the ink, moves upward along the slant surface and forms a bubble or air cell in the upper section of the auxiliary ink tank. This air is discharged from the upper section of the auxiliary ink tank through the discharge tube. Consequently, no air cell large enough to influence printing qualities is left in the upper section of each ink tank.

In the ink jet head in which is formed a communication passage for communication between upper portions of the main and auxiliary ink tanks, if an air cell is formed at the upper end of the main ink tank, it moves to the upper section of the auxiliary ink tank as the air cell formed in the upper section of the auxiliary ink tank is discharged through the discharge tube, the air of the air cell being finally discharged through the discharge tube.

DESCRIPTION OF THE PREFERRED EMBODIMENTS

Figure 1:
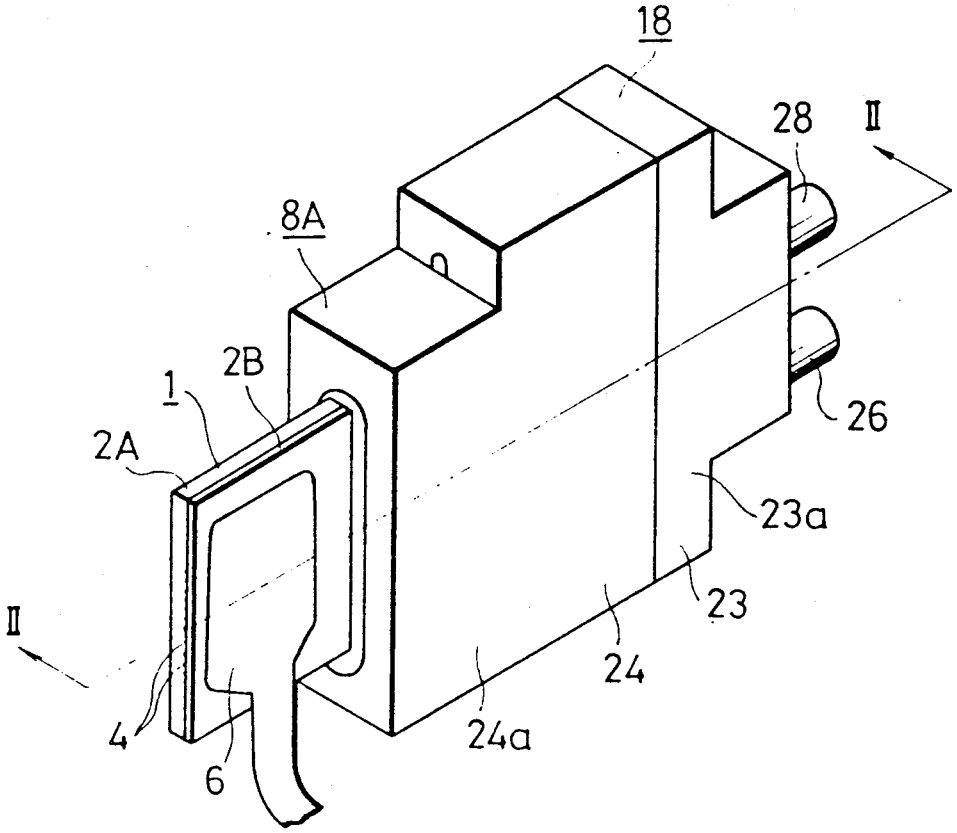
FIG. 1 is a perspective view of an ink jet head in accordance with a first embodiment of the present invention.

Embodiments of the present invention will be described below with reference to the accompanying drawings. Components identical or corresponding to those of the above-described conventional arrangement are indicated by the same reference characters and the description for them will not be repeated.

Figure 2:
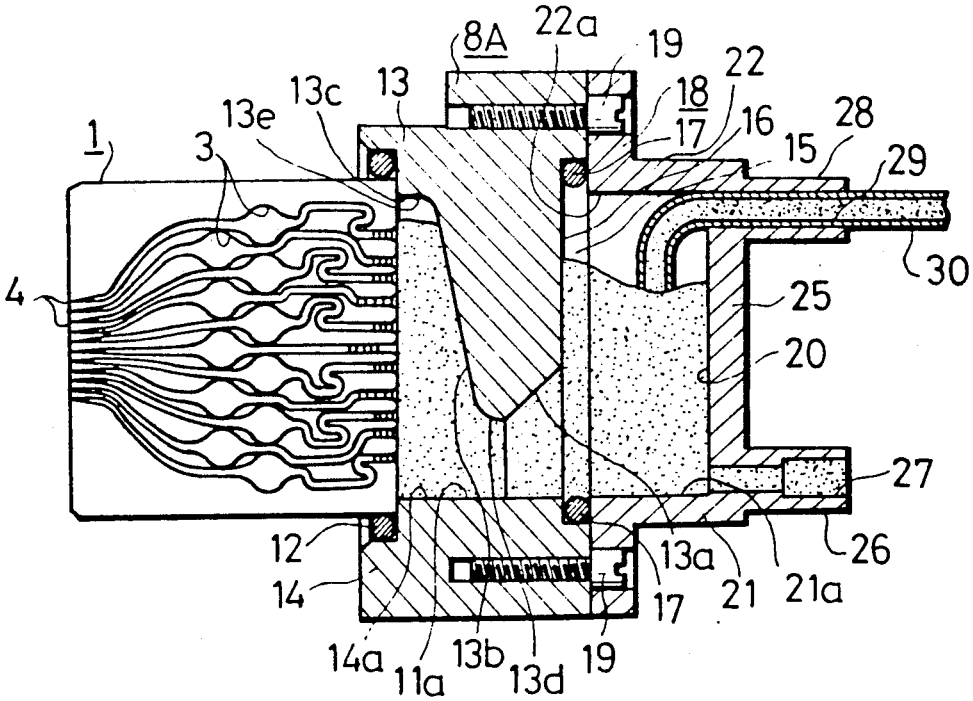
FIG. 2 is a cross-sectional view taken along the line II—II of FIG. 1.

FIGS. 1 and 2 show an ink jet head in accordance with the first embodiment of the present invention.

As shown in FIGS. 1 and 2, a tank member 8A is connected to a flat nozzle block 1, as in the case of the conventional ink jet head. An upper wall 13 of an ink tank 11A of the tank member 8A has a first slant surface **13*a* downwardly inclined from an upstream position to a downstream position with respect to the direction of ink supply, a second slant surface 13*b* upwardly inclined, and a horizontal surface 13*c*** extending horizontally.

The distance in the vertical direction between the first slant surface **13*a* and a horizontal upper surface 14*a* of a bottom wall 14 of the ink tank 11A is not greater than ½ of the distance in the vertical direction between the horizontal surface 13*c* and the upper surface 14*a* even at the upstream end with respect to the direction of ink supply, where it is maximized, and it is about ¼ of the distance in the vertical direction between the horizontal surface 13*c* and the upper surface 14*a* at the position where the first slant surface 13*a* is connected to the second slant surface 13*b***, and where it is minimized.

The first slant surface **13*a* is connected to the second slant surface 13*b* through a circular-arc surface 13*d*, and the second slant surface 13*b* is connected, through a circular-arc surface 13*e*, to the horizontal surface 13*c* positioned above the uppermost flow passage 3 of the flat nozzle block 1**.

A lengthwise generally rectangular recess 15 is formed in the end surface of the tank member 8A on the upstream side thereof with respect to the direction of ink supply. A filter 16 and an O ring 17 are fitted in the recess 15, and the filter 16 is maintained in close contact with an upstream edges of the ink tank 11A of the tank member 8A by the O ring 17. An auxiliary tank member 18 having a rectangular parallelepiped-like overall shape is connected to the tank member 8A with screws 19 so as to be maintained in close contact with the O ring 17. An auxiliary ink tank 20 which communicates with the ink tank 11A of the tank member 8A is formed in the auxiliary tank member 18. A horizontal upper surface **21*a* of a bottom wall 21 of the auxiliary ink tank 20 is flush with the upper surface 14*a* of the ink tank 11A of the tank member 8A, and a lower surface 22*a* of an upper wall 22 of the auxiliary ink tank 20 is flush with the horizontal surface 13*c* of the ink tank 11A. Further, side surfaces 23*a* of side walls 23 of the auxiliary ink tank 20 are flush with side surfaces 24*a* of side walls 24 of the ink tank 11A**.

Cylindrical projections 26 and 28 in which through holes 27 and 29 communicating with the auxiliary ink tank 20 are formed are respectively formed on lower and upper portions of a side surface 25 of the auxiliary tank member 18 located at the upstream end of the auxiliary ink tank 20 with respect to the direction of ink supply. The through hole 27 of the lower projection 26 communicates with an ink supply source (not shown), while a discharge tube 30 is inserted in the through hole 29 of the upper projection 28. One end of the discharge tube 30 is opened in an upper section of the auxiliary ink tank 20, while the other end of the discharge tube 30 is led to a surplus ink recovery section (not shown). A valve (not shown) is inserted in an intermediate portion of the discharge tube 30.

The operation of the embodiment thus arranged will be described below.

When the ink jet head in accordance with this embodiment is formed by assembling the nozzle block 1, the tank member 8, the auxiliary tank member 18, the discharge tube 30 and other components, it is not necessary to opreviously fill the ink tank 11A of the tank member 8A and the auxiliary ink tank 20 of the auxiliary tank member 18 with ink, and these members may be assembled in the empty state.

After the ink jet head has been assembled in this manner, the valve inserted in the discharge tube 30 is opened and ink is pressurized and forced into the auxiliary ink tank 20 through the through hole 27. The greater part of the ink forced into the auxiliary ink tank 20 rapidly fills this tank having a smaller internal pressure by being opened to the atmospheric air through the discharge tube 30. Finally, the discharge tube 30 is also filled with the ink.

When the ink starts flowing out from the end of the discharge tube 30, the valve inserted in the discharge tube 30 is closed. The ink formed into the auxiliary ink tank 20 then suitably flows into the ink tank 11A of the tank member 8A through the filter 16 so that air existing in the ink tank 11A is discharged to the outside via the flow passages 3, and so that the ink tank 11A and the flow passages 3 are filled with the ink. Air contained in the ink flowing from the auxiliary ink tank 20 of the auxiliary tank member 18 into the ink tank 11A of the tank member 8A is separated from the ink as the ink collides against the first slant surface **13*a* of the tank member 8A. The air separated moves upward along the first slant surface 13*a* and is finally accumulated in the auxiliary ink tank 20. Consequently, substantially no bubbles of air contained in the ink are formed in an upper section of the ink tank 11A, while only bubbles of a part of air which is to be discharged through the flow passages 3** when the ink is forced into the tank are left.

After the flow passages 3, the ink tank 11, the auxiliary ink tank 20, the discharge tube 30 and so on have been filled with the ink, a predetermined printing operation such as that described above is performed while resupplying ink into the auxiliary tank 20 through the through hole 27. During this operation, the unillustrated valve inserted in the discharge tube 30 is maintained in the closed state. The ink is successively resupplied to the ink tank 11A from the auxiliary ink tank 20. The resupplied ink collides against the first slant surface 13*a*, and air contained in it is thereby separated. This air form an air bubble or air cell in the upper section of the auxiliary ink tank 20 to prevent occurrence of a situation that the air cell in the upper section of the ink tank 11A expands as the ink is resupplied, thus avoiding the risk of a bad influence of the air cell upon printing qualities. As the air cell formed in the upper section of the auxiliary ink tank 20 becomes greater, the level of the ink in the auxiliary ink tank 20 is lowered and the opening of the end of the discharge tube 30 is exposed, so that the air of the air cell in the auxiliary ink tank 20 is partially discharged to the outside through the discharge tube 30.

In this embodiment, as described above, the auxiliary tank member 18 adjacent to the tank member 8A is provided and air contained in the ink is led to the upper section of the auxiliary ink tank 20 formed in the auxiliary tank member 18. There is therefore no risk of the air cell formed in the upper section of the ink tank 11 of the tank member 8A considerably influencing printing qualities.

Figure 3:
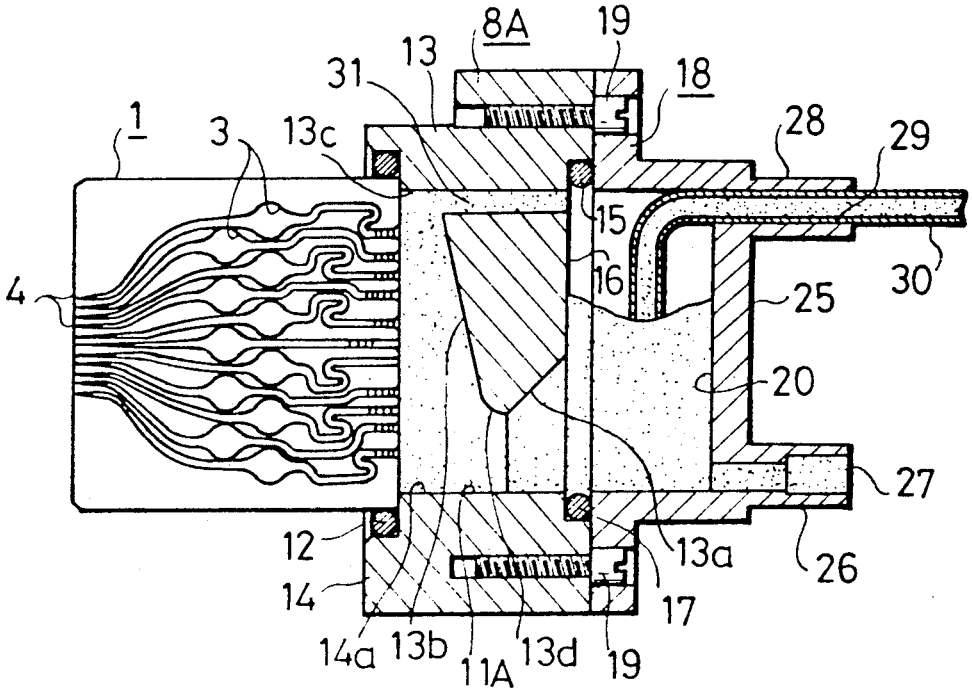
FIGS. 3 and 4 are cross-sectional views corresponding to FIG. 2, showing other embodiments of the present invention.

FIG. 3 shows another ink jet head in accordance with the second embodiment of the present invention.

As shown in FIG. 3, a communication hole 31 is formed in the upper wall 13 of the ink tank 11A of the tank member 8A so as to extend generally horizontally and to provide a communication between an upper end portions of the ink tank 11*a* and the auxiliary ink tank 20 of the auxiliary tank member 18.

Except for this, the arrangement is the same as that of the first embodiment, and the description for it will not be repeated.

In this arrangement, an air cell formed in an upper section of the ink tank 11A of the tank member 8A can be removed to the auxiliary ink tank 20 through the communication hole 31 since an air cell formed in an upper section of the auxiliary ink tank 20 of the auxiliary tank member 18 is partially discharged through the discharge tube 30 as its volume is increased. It is thereby possible to hinder formation of the air cell in the upper section of the ink tank 11A with improved stability.

Figure 4:
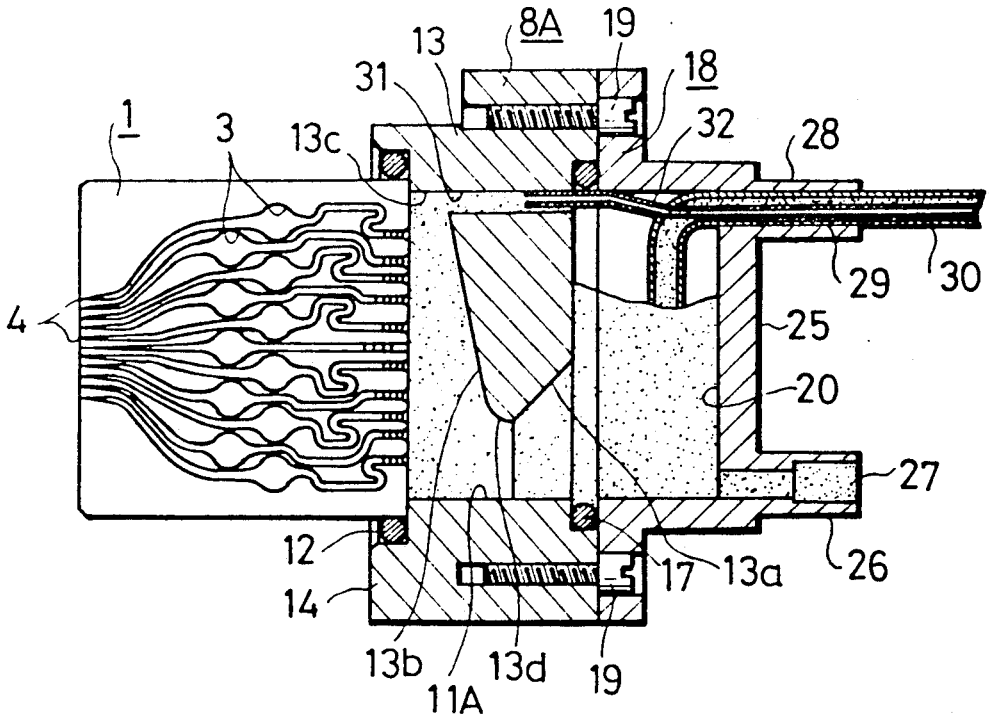
Figure 5:
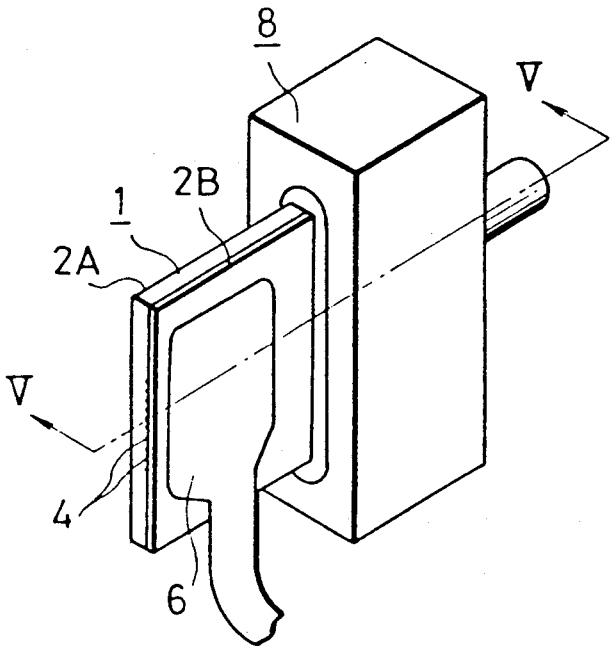
Fig. 5 PRIOR ART
FIG. 5 is a perspective view of a conventional ink jet head.
Figure 6:
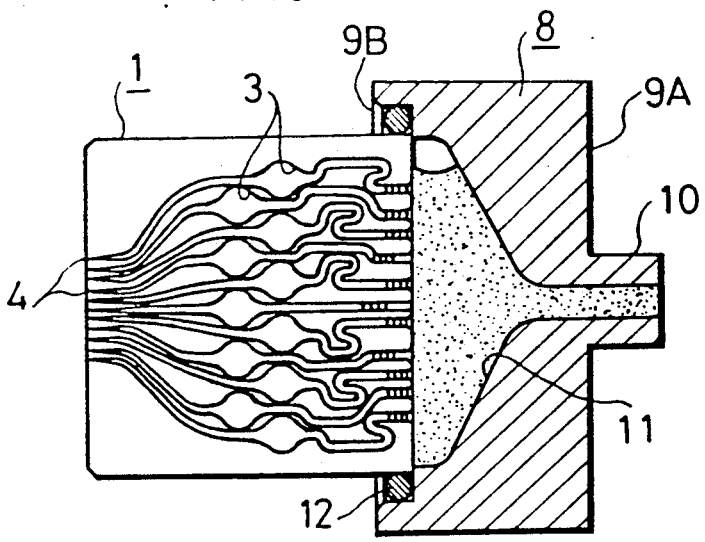
Fig. 6 PRIOR ART
FIG. 6 is a cross-sectional view taken along the line V—V of FIG. 5.
Figure 7:
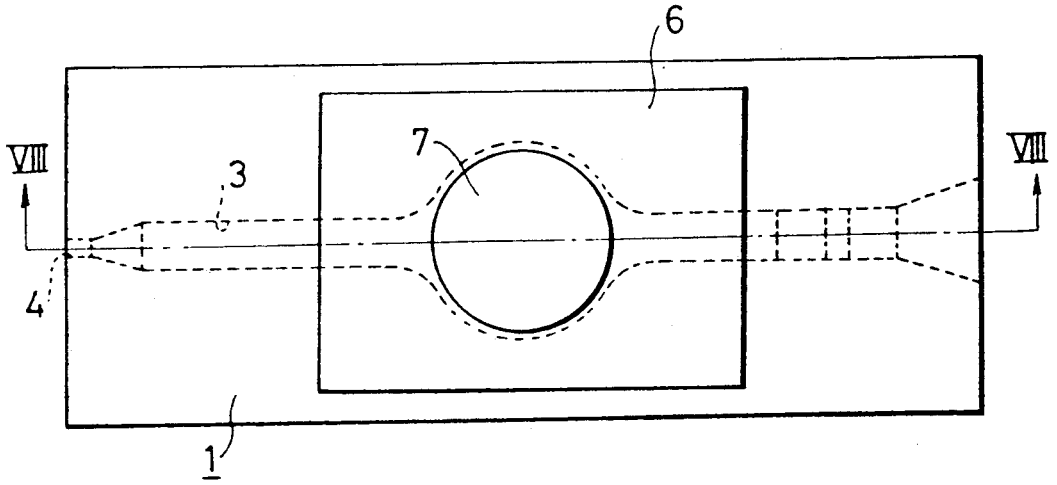
Fig.7 PRIOR ART
FIG. 7 is an enlarged cross-sectional view of an essential portion of FIG. 5.
Figure 8:
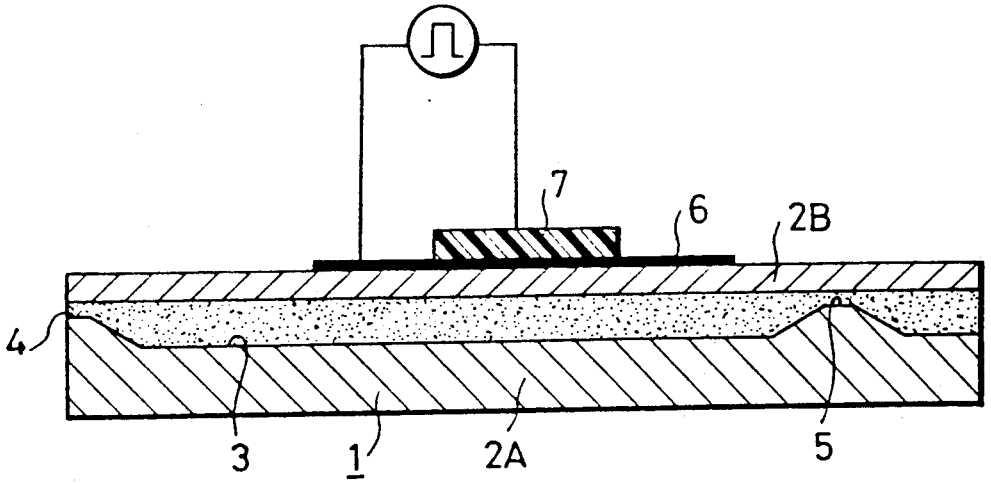
Fig.8 PRIOR ART
FIG. 8 is a cross-sectional view taken along the line VIII—VIII of FIG. 7.

FIG. 4 shows another ink jet head in accordance with the third embodiment of the present invention.

As shown in FIG. 4, a communication hole 31 similar to that shown in FIG. 3 is formed in the upper wall 13 of the ink tank 11A of the tank member 8A. The inside diameter of the communication hole 31 is smaller than the inside diameter of the discharge tube 30. One end of another discharge tube 32 is closely fitted in the communication hole 31, and the other end of the discharge tube 32 is led into the discharge tube 30 through an intermediate portion of the same.

Except for this, the arrangement is the same as that of the first embodiment, and the description for it will not be repeated.

In this arrangement, an upper section of the ink tank 11A can communicate with atmospheric air through the communication hole 31 and the discharge tube 32. To remove an air cell formed in the upper section of the ink tank 11A, the discharge tubes 32 and 30 are opened to atmospheric air so that the air can be discharged to the outside through the communication hole 31 and the discharge tube 32 by the ink supply pressure. No bubble or air cell therefore remains in the upper section of the ink tank 11A, and it is possible to prevent a bad influence of the air cell upon printing qualities with improved reliability.

In this embodiment, the discharge tube 32 is inserted into and led through the discharge tube 30 to the outside. Alternatively, the discharge tube 32 is led and opened to atmospheric air independently of the discharge tube 30.

The present invention is not limited to the above-described embodiments and various changes and modifications can be made within the spirit and scope of the present invention.

In the ink jet head in accordance with the present invention, as described above, an air bubble or air cell formed in the ink tank is minimized to prevent a considerable influence upon printing qualities.

What is claimed is:

1. An ink jet head having a flat nozzle block in which a plurality of flow passages each having one end formed as a nozzle are formed, and a main tank member which is connected to a base end of said nozzle block and in which a main ink tank for storing ink to be supplied to the flow passages is formed, said ink jet head comprising:

an auxiliary tank member connected to said main tank member, an auxiliary ink tank communicating with said main ink tank being formed in said auxiliary tank member;

a discharge member provided on said auxiliary tank member, said discharge member communicating with an upper section of said auxiliary tank;

a slant surface formed as a part of a lower surface of an upper wall of said main ink tank, said slant surface being downwardly inclined from an upstream position to a downstream position with respect to a direction of ink supply; and another discharge member communicating with an upper section of said main ink tank.

2. An ink jet head having a flat nozzle block in which a plurality of flow passages each having one end formed as a nozzle are formed, and a main tank member which is connected to a base end of said nozzle block and in which a main ink tank for storing ink to be supplied to the flow passages is formed, said ink jet head comprising:

an auxiliary tank member connected to said main tank member, an auxiliary ink tank communicating with said main ink tank being formed in said auxiliary tank member;

a discharge member provided on said auxiliary tank member, said discharge member communicating with an upper section of said auxiliary tank;

a slant surface formed as a part of a lower surface of an upper wall of said main ink tank, said slant surface being downwardly inclined from an upstream position to a downstream position with respect to a direction of ink supply; and wherein the lower surface of the upper wall of said main ink tank includes a first slant surface downwardly inclined from an upstream position to a downstream position with respect to the direction of ink supply, and a second slant surface adjacent to the first slant surface, said second slant surface being upwardly inclined from an upstream position to a downstream position.

* * * * *